United States Patent [19]

Fukuda et al.

[11] Patent Number: 4,933,024

[45] Date of Patent: Jun. 12, 1990

[54] METHOD FOR MANUFACTURING A HIGH STRENGTH RAIL WITH GOOD TOUGHNESS

[75] Inventors: Kozo Fukuda; Tsunemi Wada; Ichiro Nakauchi; Shinichi Nagahashi; Yoshio Saito; Kiyotaka Morioka; Yuzuru Kataoka; Yuzu Kato; Toyokazu Teramoto; Akio Fujibayashi, all of Tokyo, Japan

[73] Assignee: NKK Corporation, Tokyo, Japan

[21] Appl. No.: 252,878

[22] Filed: Oct. 3, 1988

[51] Int. Cl.[5] ..... C21D 9/04

[52] U.S. Cl. ..... 148/12 F; 148/146

[58] Field of Search ..... 148/12 F, 146

[56] References Cited

U.S. PATENT DOCUMENTS

| | | | |
|---|---|---|---|
| 4,040,872 | 8/1977 | Mudiare | 148/12 F |
| 4,082,577 | 4/1978 | Heller | 148/146 |
| 4,486,243 | 12/1984 | Lambert et al. | 148/146 |
| 4,749,419 | 6/1988 | Sommer et al. | 148/146 |

FOREIGN PATENT DOCUMENTS

| | | | |
|---|---|---|---|
| 0186373 | 7/1986 | European Pat. Off. | 148/146 |
| 0128123 | 5/1988 | Japan . | |
| 0256803 | 10/1983 | U.S.S.R. | 148/146 |

*Primary Examiner*—Upendra Roy

*Attorney, Agent, or Firm*—Frishauf, Holtz, Goodman & Woodward

[57] ABSTRACT

A method for manufacturing a high strength rail with good toughness, comprises cooling a rail to $Ar_3$ transformation point or less after hot rolling; heating said cooled rail at a temperature of an austenite temperature zone ranging from $Ac_3$ transformation point to 950° C.; and cooling the heated rail. The chemical composition of the rail consists of 0.50 to 0.85 wt. % C, 0.50 to 1.50 wt. % Mn, 0.035 wt. % S or less, 0.10 to 1.00 wt. % Si, 0.035 wt. % P or less, 0.050 wt. % Al or less and the balance of Fe and inevitable impurities.

26 Claims, 2 Drawing Sheets

METHOD FOR MANUFACTURING A HIGH STRENGTH RAIL WITH GOOD TOUGHNESS

BACKGROUND OF THE INVENTION

1. Field of the Invention

The present invention relates to a method for manufacturing a high strength rail with good toughness, and more particularly to a heat treatment carried out after hot rolling.

2. Description of the Prior Art

As a method of manufacturing very effectively a high strength steel rail having a fine pearlitic structure, there has been developed a method wherein a high strength rail can be obtained by charging a rail into a cooling apparatus after having subjected it to hot rolling and, thereafter, subjecting a rail head to forced cooling. In this method, cooling means applied after the hot rolling is only different from a conventional natural cooling and a toughness of the rail almost equal to that of an ordinary rail can be obtained.

In recent years, not only an outstanding wear resistance, but also a high toughness has been required for a high strength rail from a viewpoint of safety in a railway service. As a method for manufacturing the high strength rail having a good toughness with comparatively high productivity, there is pointed out a method wherein an attempt is made to make austenite grains of the rail finer at the time of roll finishing by controlling a rolling temperature and a draft during hot rolling, that is, by means of controlled rolling and by subjecting the rail to a forced cooling immediately after the finish of the rolling. In this method, however, there are problems mentioned below:

(a) In case of carrying out the controlled rolling, the rolling temperature is controlled. Therefore, a stand-by natural cooling is required during the rolling. In consequence, production efficiency in the controlled rolling decreases remarkably compared with that in ordinary rolling.

(b) In the controlled rolling, the rolling is carried out at a temperature of austenite low temperature zone. Therefore, accuracy of a rolled shape of the rail is hard to be obtained due to complicated shapes of the rail.

(c) In the rolling carried out at a temperature of the austenite low temperature zone, there is a possibility of breakdown of a roll due to an increase of a rolling load.

SUMMARY OF THE INVENTION

It is an object of the present invention to provide a method for manufacturing a high strength steel rail of a fine pearlitic structure with more outstanding toughness than that obtained by a mere high cooling rate method by means of a successive heat treatment after hot rolling, production efficiency of the hot rolling being kept. To accomplish the above-mentioned object in accordance with the present invention, a method for manufacturing a high strength rail with good toughness is provided, comprising:

cooling a rail to $Ar_3$ transformation point or less after hot rolling;

heating said cooled rail at a temperature of an austenite temperature zone ranging from $Ac_3$ transformation point to 950° C.; and cooling the heated rail.

Another method for manufacturing a high strength rail with good toughness is provided, comprising:

cooling a rail to $Ar_3$ transformation point or less after hot rolling, the rail consisting of 0.50 to 0.85 wt.% C, 0.50 to 1.50 wt.% Mn, 0.035 wt.% S or less, 0.10 to 1.00 wt.% Si, 0.035 wt.% P or less, 0.050 wt.% Al or less and the balance of Fe and inevitable impuruties;

heating said cooled rail at a temperature of an austenite temperature zone ranging from $Ac_3$ transformation point to 950° C. and cooling the heated rail.

A still further method for manufacturing a high strength rail with good toughness is provided, comprising:

cooling a rail to $Ar_3$ transformation point or less after hot rolling, the rail containing 0.50 to 0.85 wt.% C, 0.50 to 1.50 wt.% Mn, 0.035 Wt.% S or less, 0.10 to 1.00 wt.% Si, 0.035 wt.% P or less and 0.050 wt.% Al or less, and further containing at least one selected from the group consisting of 0.05 to 1.50 wt.% Cr, 0.10 to 1.00 wt.% Ni, 0.005 to 0.50 wt.% Nb, 0.01 to 0.20 wt.% Mo, 0.01 to 0.10 wt.% V, 0.001 to 0.015 wt.% Ti and the balance of Fe and inevitable impurities;

heating said cooled rail at a temperature of an austenite temperature zone ranging from $Ac_3$ transformation point to 950° C.; and cooling the heated rail.

The above objects and other objects and advantages of the present invention will become apparent from the detailed description to follow, taken in connection with the appended drawings.

DESCRIPTION OF THE PREFERRED EMBODIMENT

Figure 1:
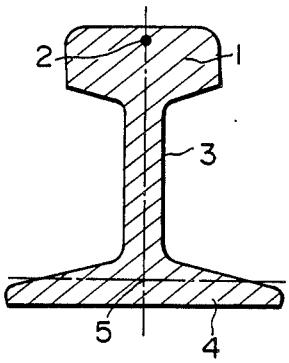
FIG. 1 is a sectional view illustrating a rail.

An increase of productivity is also one of the important requisites in the present invention. It is necessary to complete perfectly a transformation by cooling the rail to $Ar_3$ transformation point or less after hot rolling, but it is necessary to cool the rail by taking a lot more time than necessary. To shorten the time and to make good use of sensible heat, it is desirable to charge promptly the rail into a heating furnace. The structure of the rail charged into the heating furnace is transformed again by heating into austenite structure at $Ac_3$ transformation point. The austenite structure produced by heating becomes very fine compared with austenite grains of the rail hot rolled at first. In order to obtain this fine structure, it is indispensable to cool the above-mentioned rail to $Ar_3$ transformation point or less after the hot rolling to complete perfectly the transformation. Since insoluble cementite structure remains in austenite structure immediately after the transformation, hardenability of the rail becomes inhomogeneous and decreases. To solve this insoluble cementite structure and secure a stable hardenability, a heating temperature needs to be raised to a temperature higher than $Ac_3$ transformation point. The austenite having become fine grows into coarse grains with the grain-growth caused by the rise of the heating temperature. Therefore, it is necessary to heat the rail at a temperature of less than 950° C. When the heating temperature exceeds 950° C., the austenite grains are coarsened drastically with the growth of the grains. A rail head having a fine structure and which is in an austenite state is cooled forcedly. The austenite structure transforms into a high strength fine pearlitic structure through the forced cooling. This fine pearlitic structure is very fine because it takes over the fineness of the austenite grains. The fine pearlitic structure is a cause of the high toughness. On the other hand, a web and a foot of the rail can be either an ordinary pearlitic structure with high toughness by means of natural cooling or a fine pearlitic structure by means of the forced cooling as the rail head. The present invention can be applied either to a rail after the ordinary hot rolling or to a rail after the controlled rolling.

Subsequently, the chemical composition of steel favorable for applying the present invention will now be explained.

C: C is an indispensable element relative to wear resistance of steel. If the content of C in steel is less than 0.50 wt.%, steel wears rapidly and cannot be wear resistant steel for practical use. If the content of C in steel exceeds 0.85 wt.%, a pro-eutectoid cementite occurs in the metal structure and this leads to a deterioration of ductility of steel. Accordingly, the content of C is desired to be 0.50 to 0.85 wt.%

Si: Si is a deoxidizing element and, at the same time, an element necessary for increasing the strength of steel. Killed steel is desired to contain 0.10 wt.% Si or more as the deoxidizing element. It is greatly effective to add more Si to steel so as to increase the strength of steel. However, if the content of Si exceeds 1.00 wt.%, the ductility of steel decreases remarkably. Therefore, the content of Si is desired to be 1.00 wt.% or less. Accordingly, the content of Si is preferred to be from 0.10 to 1.00 wt.%.

Mn: Mn is an element necessary for increasing the strength of steel. The content of Mn is desired to be from 0.50 to 1.50 wt.%. The content of Mn less than 0.50 wt.% has little effect in increasing the strength of steel. The content of Mn more than 1.50 wt.% produces a bad influence on weldability.

P and S: P and S are impurity elements. If each content P and S exceeds 0.035 wt.%, both of ductility and toughness of steel worsen. Therefore, the content of each of P and S is desired to be 0.035 wt.% or less. The smaller the content of P and S is, the better the ductility and the toughness of steel become. The content of 0.010 wt.% P and of S or less has a great effect on the ductility and the toughness of steel and leads to an improvement of weldability. Therefore, the content of each of P and S is desired to be 0.010 wt.% or less.

Al: Al is used as a deoxidizing element together with Si. However, if the content of Al exceeds 0.050 wt.%, the occurrence of $Al_2O_3$ increases and the fatigue property of steel worsens. Therefore, the content of Al is desired to be 0.050 wt.% or less.

The chemical composition as mentioned above is favorable for rail steel suitable for a continuous manufacturing process of the present invention and important for making a rail head to be of high strength fine pearlitic structure. Besides the above-mentioned elements, additive elements can be added to steel to manufacture the rail steel effectively with high efficiency.

A favorable additional amount of the additive elements are shown below:

Cr: Cr facilitates steel to be of a fine pearlitic structure by increasing hardenability and, at the same time, increases the resistance to softening of the pearlitic structure at the time of annealing. Consequently, the high strength pearlitic structure can be obtained easily. The content of Cr is desired to be from 0.05 to 1.50 wt.%. The content of 0.05 wt.% Cr or less has little effective in increasing hardenability. If the content of Cr exceeds 1.50 wt.%, weldability worsens.

Mo: Mo as much as Cr makes it easy to increase hardenability of steel and the resistance to softening of the pearlitic structure at the time of annealing and to obtain high strength fine pearlitic structure. The content of Mo is from 0.01 to 0.20 wt.%. The content of less than 0.01 wt.% Mo has little effective in increasing hardenability. If the content of Mo exceeds 0.20 wt.%, weldability worsens.

Ni: Ni is effective in increasing hardenability, strength and toughness of steel. The content of 0.10 wt.% Ni or less has little effective in increasing hardenability. If the content of Ni exceeds 1.00 wt.%, the effectiveness in the increase of hardenability is saturated.

V, Nb and Ti: Most of V, Nb and Ti exist in steel as precipitates combined with C or N at a temperature of 950° C. or less and contribute greatly to the increase of toughness by suppressing the growth of fine austenite grains in an austenite structure at temperature from $Ac_3$ transformation point to 950° C. To suppress the growth of austenite grains in an austenite structure at temperature from $Ac_3$ transformation to 950° C. To suppress the growth of the austenite grains, the content of 0.01 wt/% V or more, 0.005 wt.% Nb or more and 0.001 wt.% Ti or more is desirable. Because the effectiveness to suppress the growth of the grains is saturated, the content of 0.10 wt.% V or less, 0.05 wt.% Nb or less and 0.015 wt.% Ti or less is desirable.

Subsequently, the essential points of a continuous manufacturing process according to the present invention will now be explained.

A rail is cooled to $Ar_3$ transformation point or less by means of a natural cooling or a forced cooling after hot rolling. The temperature at which the transformation completes perfectly is the highest in case of the natural cooling. In this case, the temperature is approximately from 600° to 720° C. To make use of sensible heat of the rail to be charged into a heating furnace, the sensible heat of at least 300° C. or more is required. Therefore, the temperature of the cooled rail is desired to be from 300° to 720° C. The temperature of the rail of from 400° to 650° C. is more desirable because it is applied easily. In the heating furnace, the rail is heated at a temperature of from $Ac_3$ transformation point to 950° C. If holding time of the rail in the heating furnace is 2 hours or less, the austenite grains grow a little. A preferable holding time of the rail in the heating furnace is from 1 to 30 minutes.

Further, tensile strength of 100 kgf/mm$^2$ or more can be obtained by means of a forced cooling of a rail head. To make the rail head be of the high strength fine pearlitic structure with good toughness as mentioned above, a cooling rate of 1° to 15° C./sec. is desired in a pearlite transformation temperature zone. A web and a foot of the rail are desired to be cooled by means of a natural cooling or a forced cooling at a cooling rate of 15° C./sec. or less in compliance with portions of a railway where the rail is used.

The manufacturing process of the present invention can be easily applied, by means of modification of the cooling apparatus and instalation of a tempering furnace, to the maufacture of a high performance rail whose head is made to be of high strength fine pearlitic structure and whose web and foot are made to be of tempered martensite-bainite structure or of tempered bainite structure. The manufacturing process of the present invention can also be applied to a method of further increasing toughness of a rail with the use of a tempering furnace set near by the apparatus used in the present invention. It is a matter of course that the contiuous manufacturing process of the present invention can be applied to a method of manufacturing an ordinary rail for the sole purpose of increasing toughness of the rail.

FIG. 1 is a sectional view indicating a name of each portion of a rail used in the present specification.

In the drawing, referential numeral 1 denotes a rail head, 2 a top of the rail, 3 a web of the rail, 4 a foot of the rail and 5 a center of the foot.

Example 13 species of steel in total from A to M having the chemical composition listed in Table 1 were subjected to a continuous heat treatment.

In Table 2, the conditions of heat treatment in a known prior art method wherein a rail is cooled forcedly immediately after it has been hot rolled and in the method of the present invention are compared relative to steel from A to M. In Table 3, mechanical properties of a rail subjected to the forced cooling immediately after hot rolling in the known prior art method of a rail subjected to a heat treatment in the method of the present invention are compared relative to steel from A to M.

Figure 2:
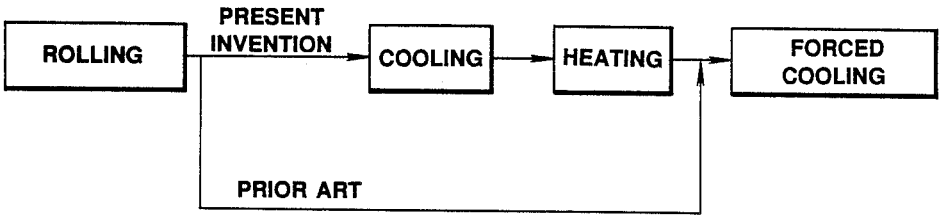
FIG. 2 is a flow chart showing manufacturing processes according to a prior art method and a method of the present invention.

FIG. 2 is a flow chart designating the manufacturing process of the prior art method and the method of the present invention.

Figure 3:
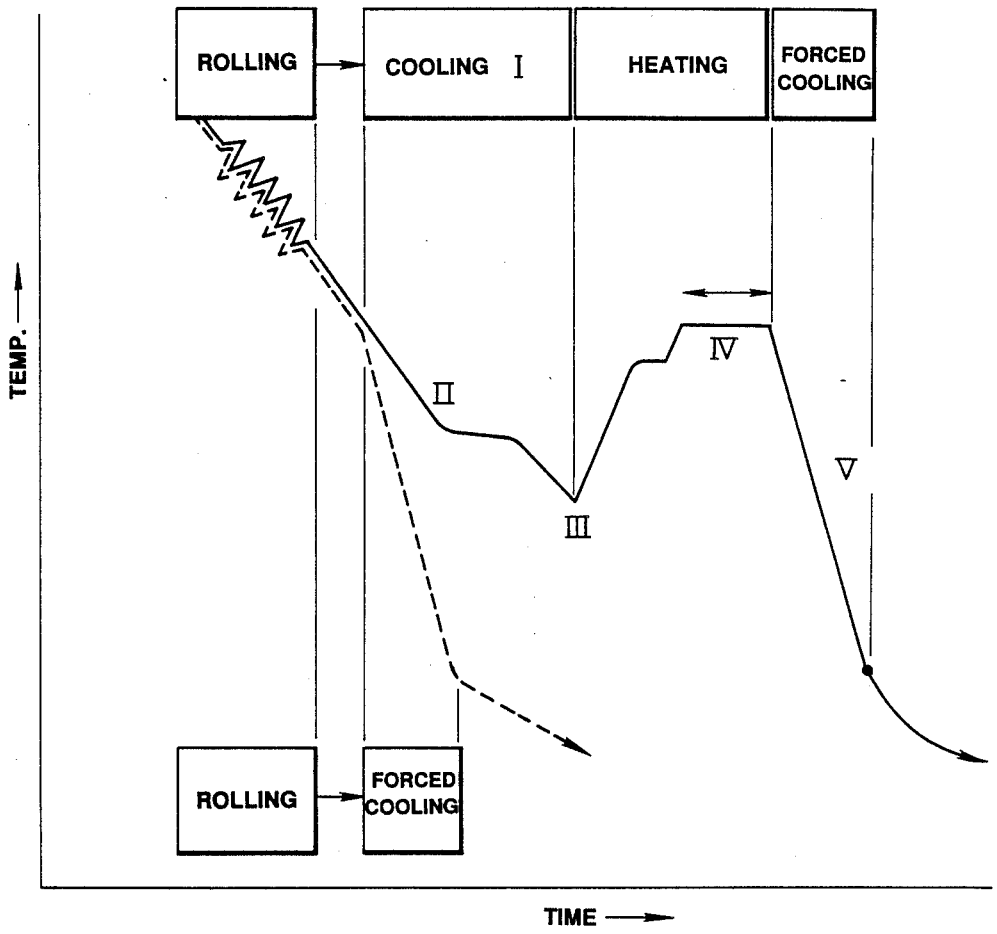
FIG. 3 is an explanatory outline view illustrating each of the manufacturing processes of the present invention in comparison with the prior art relative to lapse of time and change of temperature of the rail.

FIG. 3 is an explanatory outline view illustrating each of the manufacturing processes of the present invention in comparison with the prior art relative to lapse of time and change of temperature of the rail. Numerals in FIG. 3 denote the following which correspond to I to V in Table 2.

Cooling

Transformation temperature

Temperature for charging a rail into a heating furnace

Keeping the rail in the heating furnace

Cooling The solid line shows a method of the present invention and the broken line shows a method of prior art.

The cooling rate of 0.3° C./sec. in FIG. 2 is the cooling rate by means of the natural cooling. The cooling rate is an average cooling rate of 750° C. and 500° C. A temperature of the top of the rail head was measured at 5 mm below the top of the rail head and a cooling rate was found. Mechanical properties of the top of the rail head in Table 3 were measured at 5 mm below the top of rail head. There was no difference in tensile strength values and impact resistance values of a web and a foot of the rail and those values showed almost the same value. Therefore, the value at the center of the foot was regarded as a representative value.

It is clearly seen from Table 3 that, according to the present invention, the tensile strength of the rail equal to that obtained in the prior art process can be obtained by means of a fine pearlitic structure and a sufficient strength is imparted to the web and the foot of the rail. Particularly, relative to toughness being an object of the present invention, 2 $\mu$E+20° C. shows a value of 2 kgf.m or more. In the method of the present invention, toughness almost twice higher than that obtained in the prior art manufacturing process could be accomplished. It is recognized that, in consequence of having added Cr, Mo and Ni to steel, hardenability of the rail could be increased and cooling speed could be lowered. These compensated a decrease of hardenability of the rail caused by a refinement of austenite gains. As to V, hardenability of the rail could be increased by a partially solved V (CN). A complex addition of Cr, Mo, Ni, V, Nb and Ti contributed very effectively to the increase of hardenability and refinement of austenite grains.

As described in detail, the method of the present invention can be applied to both of the rails subjected to ordinary rolling and to controlled rolling. Moreover, it became clear that high strength steel rail having a high strength fine pearlitic structure with much better toughness than that obtained in the prior art could be obtained. Further, productivity of rolling according to the present invention is almost equal to that of ordinary rolling and rolling in an austenite low temperature zone such as controlled rolling is not necessarily required. Therefore, evils attended by the rolling in an austenite low temperature zone can be prevented. Even if unreasonable rolling were carried out, strain in the rail would have been removed by means of a heat treatment. Therefore, the present invention contributes greatly to the rail manufacturing industry.

TABLE 1

| Steel Species | Type | C | S | Mn | P | S | Al | Others | | |
|---|---|---|---|---|---|---|---|---|---|---|
| A | Si—Mn | 0.75 | 0.27 | 0.89 | 0.017 | 0.010 | 0.007 | — | — | — |
| B | Cr | 0.74 | 0.24 | 0.86 | 0.018 | 0.011 | 0.005 | Cr 0.46 | — | — |
| C | Mo | 0.76 | 0.24 | 0.85 | 0.013 | 0.009 | 0.001 | Mo 0.08 | — | — |
| D | Ni | 0.73 | 0.29 | 0.91 | 0.008 | 0.007 | 0.002 | Ni 0.51 | — | — |
| E | V | 0.77 | 0.28 | 0.95 | 0.009 | 0.003 | 0.005 | V 0.05 | — | — |
| F | Nb | 0.72 | 0.21 | 0.93 | 0.011 | 0.005 | 0.011 | Nb 0.02 | — | — |
| G | Ti | 0.76 | 0.25 | 0.87 | 0.005 | 0.002 | 0.004 | Ti 0.005 | — | — |
| H | CR—V | 0.78 | 0.51 | 0.83 | 0.020 | 0.008 | 0.003 | Cr 0.43 | V 0.05 | |
| I | Cr—Nb | 0.78 | 0.25 | 0.82 | 0.009 | 0.007 | 0.003 | Cr 0.40 | Nb 0.001 | |

TABLE 1-continued

| Steel Species | Type | C | S | Mn | P | S | Al | Others | |
|---|---|---|---|---|---|---|---|---|---|
| J | Mo—Nb | 0.77 | 0.26 | 0.85 | 0.010 | 0.008 | 0.005 | Mo 0.05 | Nb 0.03 |
| K | Ni—Nb | 0.65 | 0.24 | 1.10 | 0.010 | 0.011 | 0.010 | Ni 0.52 | Nb 0.019 |
| L | Cr—Mo | 0.70 | 0.25 | 1.01 | 0.013 | 0.005 | 0.020 | Cr 0.60 | Mo 0.10 |
| M | Cr—V—Nb | 0.77 | 0.55 | 0.84 | 0.015 | 0.009 | 0.025 | Cr 0.43 Nb 0.02 | V 0.03 |

TABLE 2(a)

| | | Conditions for Heat Treatment | | | | | |
|---|---|---|---|---|---|---|---|
| Steel Species | Manufacturing Process | Cooling Method I. | Transformation Temperature (°C.) II. | Temperature for Charging into Heating Furnace (°C.) III. | Temperature and Time for Holding (°C.) × (Min.) IV. | V. Cooling Rate (°C./sec.) Top of Head | V. Cooling Rate (°C./sec.) Center of Foot |
| A | Prior Art | — | — | — | — | 5.0 | 0.3 |
| | Present Invention | Natural Cooling | 652 | 600 | 800 × 5 | 10.2 | 10.1 |
| B | Prior Art | — | — | — | — | 3.4 | 0.3 |
| | Present Invention | Air Blast | 600 | 550 | 875 × 5 | 4.9 | 4.9 |
| C | Prior Art | — | — | — | — | 3.1 | 0.3 |
| | Present Invention | Natural Cooling | 671 | 630 | 850 × 5 | 6.0 | 5.8 |
| D | Prior Art | — | — | — | — | 3.3 | 0.3 |
| | Present Invention | Natural Cooling | 640 | 570 | 800 × 4 | 4.5 | 4.5 |
| E | Prior Art | — | — | — | — | 2.9 | 0.3 |
| | Present Invention | Natural Cooling | 660 | 620 | 850 × 5 | 5.1 | 0.3 |
| F | Prior Art | — | — | — | — | 5.4 | 0.3 |
| | Present Invention | Natural Cooling | 658 | 600 | 850 × 3 | 6.7 | 6.0 |
| G | Prior Art | — | — | — | — | 5.1 | 0.3 |
| | Present Invention | Natural Cooling | 663 | 620 | 850 × 3 | 7.4 | 7.5 |
| H | Prior Art | — | — | — | — | 2.1 | 0.3 |
| | Present Invention | Natural Cooling | 681 | 650 | 875 × 10 | 3.2 | 0.3 |
| I | Prior Art | — | — | — | — | 2.4 | 0.3 |
| | Present Invention | Water Cooling | 560 | 490 | 925 × 5 | 3.3 | 0.3 |
| J | Prior Art | — | — | — | — | 3.0 | 0.3 |
| | Present Invention | Air Blast | 610 | 545 | 900 × 5 | 4.1 | 4.5 |
| K | Prior Art | — | — | — | — | 5.2 | 0.3 |
| | Present Invention | Natural Cooling | 648 | 550 | 850 × 5 | 6.8 | 7.1 |
| L | Prior Art | — | — | — | — | 1.9 | 0.3 |
| | Present Invention | Natural Cooling | 689 | 650 | 900 × 20 | 3.0 | 0.3 |
| M | Prior Art | — | — | — | — | 2.2 | 0.3 |
| | Present Invention | Water Cooling | 510 | 400 | 929 ± 5 | 2.9 | 1.5 |

TABLE 3

| | | Mechanical Properties | | | |
|---|---|---|---|---|---|
| | | Tensile Strength (kgf/mm²) | | 2uE + 20° C. (kgfm) | |
| Steel Species | Manufacturing Process | Top of Head | Center of Foot | Top of Head | Center of Foot |
| A | Prior Art | 132 | 98 | 1.9 | 1.5 |
| | Present Invention | 131 | 130 | 3.7 | 3.6 |
| B | Prior Art | 133 | 102 | 1.7 | 1.4 |
| | Present Invention | 130 | 131 | 3.6 | 3.6 |
| C | Prior Art | 131 | 102 | 1.8 | 1.4 |
| | Present Invention | 129 | 131 | 3.7 | 3.5 |
| D | Prior Art | 130 | 100 | 2.3 | 1.8 |

TABLE 3-continued

| | | Mechanical Properties | | | |
|---|---|---|---|---|---|
| | | Tensile Strength (kgf/mm²) | | 2uE + 20° C. (kgfm) | |
| Steel Species | Manufacturing Process | Top of Head | Center of Foot | Top of Head | Center of Foot |
| | Present Invention | 128 | 130 | 4.5 | 4.6 |
| E | Prior Art | 131 | 103 | 1.8 | 1.5 |
| | Present Invention | 133 | 94 | 3.7 | 3.2 |
| F | Prior Art | 130 | 96 | 2.1 | 1.8 |
| | Present Invention | 131 | 125 | 4.1 | 3.6 |
| G | Prior Art | 133 | 98 | 2.0 | 1.7 |
| | Present | 129 | 129 | 3.8 | 3.7 |

TABLE 3-continued

| Steel Species | Manufacturing Process | Mechanical Properties: Tensile Strength ($kgf/mm^2$) Top of Head | Tensile Strength ($kgf/mm^2$) Center of Foot | 2uE + 20° C. (kgfm) Top of Head | 2uE + 20° C. (kgfm) Center of Foot |
|---|---|---|---|---|---|
| | Invention | | | | |
| H | Prior Art | 134 | 111 | 1.5 | 1.2 |
| | Present Invention | 132 | 100 | 3.1 | 2.5 |
| I | Prior Art | 129 | 104 | 1.9 | 1.6 |
| | Present Invention | 133 | 91 | 3.9 | 3.1 |
| J | Prior Art | 128 | 101 | 1.9 | 1.6 |
| | Present Invention | 128 | 131 | 3.9 | 3.9 |
| K | Prior Art | 129 | 96 | 2.5 | 2.1 |
| | Present Invention | 125 | 127 | 4.9 | 5.0 |
| L | Prior Art | 131 | 108 | 1.5 | 1.3 |
| | Present Invention | 133 | 98 | 2.7 | 2.3 |
| M | Prior Art | 131 | 109 | 1.6 | 1.4 |
| | Present Invention | 130 | 124 | 3.0 | 2.7 |

What is claimed is:

1. A method for manufacturing a high strength rail with good toughness, hot rolling a rail above the $Ar_3$ transformation point;

cooling said hot rolled rail to a temperature of from 300° to 720° C.;

then heating said cooled rail to an austenite temperature of from the $Ac_3$ transformation point to 950° C.; and cooling the heated rail.

2. The method of claim 1, wherein said cooling to $Ar_3$ teansformation point or less includes natural cooling and forced cooling.

3. The method of claim 1, wherein said heating is at a temperature of from $Ac_3$ transformation point to 950° C. for 1 to 30 minutes.

4. The method of claim 1, wherein said cooling of the heated rail is forced cooling of the rail head.

5. The method of claim 1, wherein said cooling of the heated rail cooling of the a web and a foot of the rail.

6. The method of claim 1, wherein said cooling of the heated rail is forced cooling of the web and a foot of the rail.

7. The method of claim 1, wherein said hot rolled rail is cooled to a temperature of from 400° to 650° C.

8. The method of claim 1, wherein said hot rolled rail is cooled to a temperature of from 600° to 720° C.

9. The method of claim 4, wherein said cooling is forced cooling at a cooling rate of from 1° to 15° C./sec.

10. The method of claim 5, wherein said hot rolled rail is cooled to a temperature of from 600° to 720° C.

11. The method of claim 6, wherein said forced cooling is at a cooling rate of 15° C./sec. or less.

12. The method of claim 11, wherein said hot rolled rail is cooled to a temperature of from 400° to 650° C.

13. A method for manufacturing a high strength rail with good toughness, hot rolling a rail above the $AR_3$ transformation point;

cooling said hot rolled rail to a temperature of from 300° to 720° C., the rail consisting essentially of 0.50 to 0.85 wt.% C, 0.50 to 1.50 wt.% Mn, 0.035 wt.% S or less, 0.10 to 1.00 wt.% Si, 0.035 wt.% P or less, 0.50 wt.% Al or less and the balance of Fe and inevitable impurities;

then heating said cooled rail to an austenite temperature of from the $Ac_3$ transformation point to 950° C.; and cooling the heated rail.

14. The method of claim 13, wherein said cooling of the heated rail is forced cooling of the rail head at a cooling rate of 1° to 15° C./sec.

15. The method of claim 13, wherein said cooling of the heated rail is natural cooling of the web and a foot of the rail.

16. The method of claim 13, wherein said cooling of the heated rail is forced cooling of the web and the foot of the rail at a cooling rate of 15° C./sec. or less.

17. The method of claim 13, wherein said hot rolled rail is cooled to a temperature of from 400° to 650° C.

18. The method of claim 13, wherein said hot rolled rail is cooled to a temperature of from 600° to 720° C.

19. The method of claim 12, wherein said hot rolled rail is cooled to a temperature of from 400° to 650° C.

20. A method for manufacturing a high strength rail with good toughness, hot rolling a rail above the $Ar_3$ transformation point;

cooling said hot rolled rail to a temperature of from 300° to 720° C., the rail consisting essentially of 0.50 to 0.85 wt.% C, 0.50 to 1.50 wt.% Mn, 0.035 wt.% S or less, 0.10 to 1.00 wt.% Si, 0.035 wt.% P or less, 0.50 wt.% Al or less, and further containing at least one selected from the group consisting of 0.05 to 1.50 wt.% Cr, 0.10 to 1.00 wt.% Ni, 0.005 to 0.050 wt.% Nb, 0.01 to 0.20 wt.% Mo, 0.01 wt.% V, 0.001 to 0.015 wt.% Ti and the balance of Fe and inevitable impurities;

then heating said cooled rail to an austenite temperature of from the $Ac_3$ transformation point to 950° C.; and cooling the heated rail.

21. The method of claim 20, wherein said cooling of the heated rail is forced cooling of the rail head at a cooling rate of 1° to 15° C./sec.

22. The method of claim 20, wherein said cooling of the heated rail is natural cooling of the web and a foot of the rail.

23. The method of claim 20, wherein said cooling of the heated rail is forced cooling of the web and a foot of the rail at a cooling rate of 15° C./sec.

24. The method of claim 20, wherein said hot rolled rail is cooled to a temperature of from 400° to 650° C.

25. The method of claim 20, wherein said hot rolled rail is cooled to a temperature of from 600° to 720° C.

26. The method of claim 21, wherein said hot rolled rail is cooled to a temperature of from 400° to 650° C.

* * * * *